United States Patent [19]

Riches

[11] 4,006,827

[45] Feb. 8, 1977

[54] FILE ORGANIZER

[76] Inventor: George Henry Wiseman Riches, 170 Roehampton Ave., Toronto, Ontario, Canada, M4P1R2

[22] Filed: Sept. 15, 1975

[21] Appl. No.: 613,613

[52] U.S. Cl. ..... 211/201; 211/11; 248/97

[51] Int. Cl.[2] ..... A47F 5/10

[58] Field of Search ..... 211/178, 10, 11, 38, 211/85, 104, 130, 132, 149, 40, 41, 42, 69.1, 69.5, 181, 195, 201; 206/214; 190/51, 11; 248/95, 97; 312/183, 184

[56] References Cited

UNITED STATES PATENTS

| | | | |
|---|---|---|---|
| 995,120 | 6/1911 | Cooper | 211/178 R |
| 2,913,789 | 11/1959 | Loredo | 211/69.1 X |
| 3,408,126 | 10/1968 | Mortensen | 190/51 X |
| 3,540,614 | 11/1970 | Flagg | 220/4 F |
| 3,603,541 | 9/1971 | Sturm et al. | 248/97 |
| 3,606,950 | 9/1971 | Nevai | 211/178 R X |
| R28,289 | 12/1974 | Calkins | 211/69.1 X |

FOREIGN PATENTS OR APPLICATIONS

| | | | |
|---|---|---|---|
| 116,552 | 6/1946 | Sweden | 312/184 |

*Primary Examiner*—Ramon S. Britts
*Assistant Examiner*—Terrell P. Lewis
*Attorney, Agent, or Firm*—George H. Riches

[57] ABSTRACT

A file organizer which can either stand on a desk and which, when loaded will fit conveniently in a briefcase. The file organizer consists of a pair of frames connected together by a pair of support members which hold the frames in substantially parallel and spaced apart relationship. The connection is such as to allow the organizer to be easily adjusted for different depths of briefcases. As an additional feature it has a compartment supported by one of the frames for pencils, pens, etc.

5 Claims, 5 Drawing Figures

FILE ORGANIZER

BACKGROUND OF THE INVENTION

A briefcase is a small rectangular case, generally made of rigid material, for carrying papers etc. It is usually of a depth of from a few inches to several inches. The files, to be carried in the case are placed, in a pile, flat in the briefcase but this is not very convenient since, if a file which is required is in the middle of the pile, the files on top either have to be disturbed or be removed in order to reach the file desired. It is difficult to locate a file when it is laying flat in a pile with other files. The most convenient way of locating the file desired is to have all of the files standing upright with their index tabs clearly visible.

OUTLINE OF THE INVENTION

This invention is to provide a file organizer in which the files are stored and which can be placed, with its load of files in a briefcase when required. The organizer will allow the files to lay flat in the briefcase when closed and in a vertical or upright position when the briefcase is opened. The file organizer is foldable, widthwise, so that it will readily fit into briefcases of various widths. As an additional feature the briefcase organizer has a pocket for writing tools and accessories.

The file organizer is a convenient device for standing on a desk for holding files upright in an orderly and visible manner.

DESCRIPTION OF THE INVENTION

A preferred embodiment of the invention is described in the following disclosure and is illustrated in the accompanying drawings in which.

Figure 3:
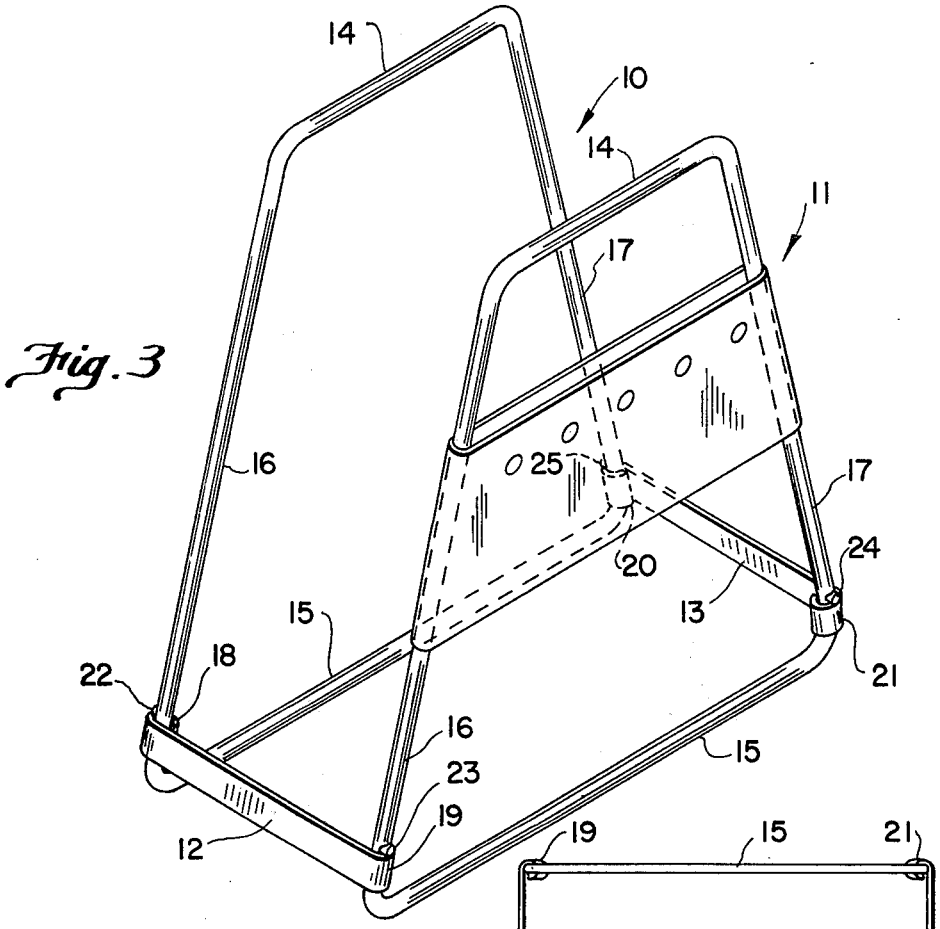
FIG. 3 is a perspective view of the file organizer in its expanded position.
Figure 5:
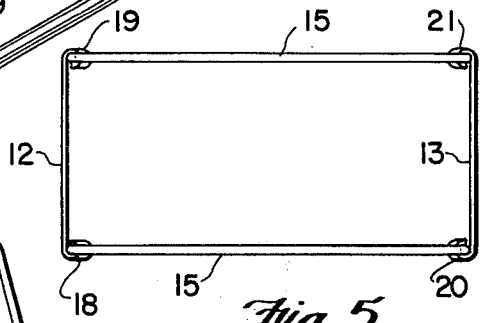
FIG. 5 is a bottom plan view of the organizer.
Figure 4:
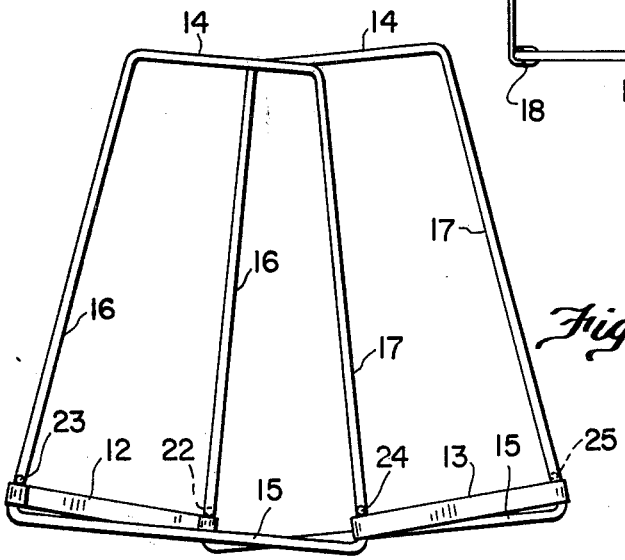
FIG. 4 is a front elevation showing the file organizer closed.

The file organizer illustrated in FIGS. 3 to 5 comprises a pair of frames generally indicated by the numbers 10, 11 and a pair of support members 12, 13 which connect the frames together into a unit and support them in an upright position when they are opened up to hold files.

An inexpensive way of making each frame, preferably identical in size and shape, is to manufacture it from relatively rigid wire which is bent to form a quadrilateral having parallel upper member 14 and base member 15 and a pair of side members 16, 17 in converging relationship so that the member 14 is shorter than the member 15. It is, of course, to be understood that the particular shape described or the material from which the frame is made is not essential. The wire frames have been selected because they do not materially increase the weight of the case. The height of the frame members, for convenience, is slightly less than the width of a standard file folder and the width slightly less than the length of a standard letter file folder. While wide variations in sizes are possible, it is essential that the width of each frame should be substantially less than the length of the briefcase and that the height be less than the width of the briefcase.

Figure 1:
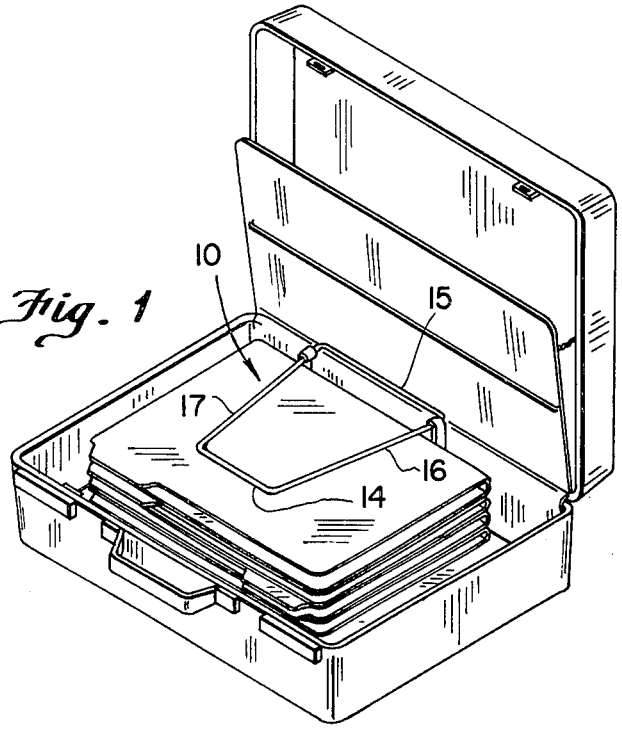
FIG. 1 shows the organizer in use in a briefcase with a number of files laying flat therein.
Figure 2:
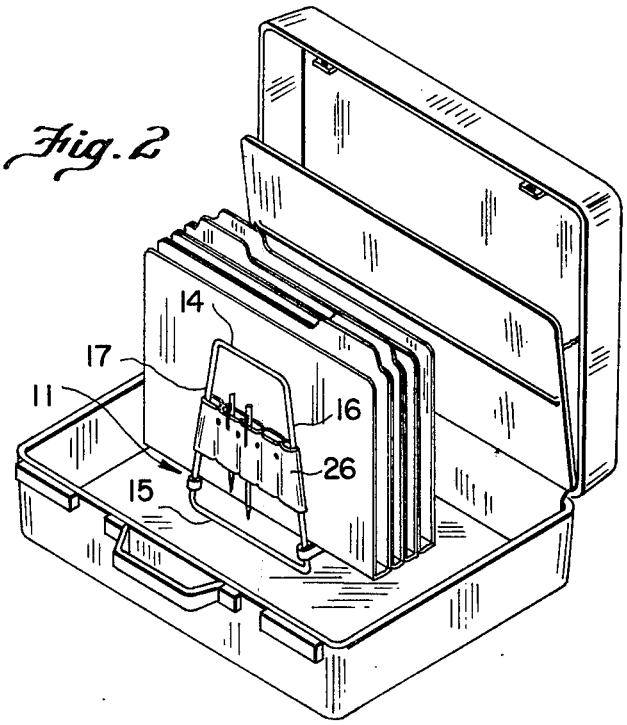
FIG. 2 shows the organizer in a vertical position.

The support members 12, 13 are formed of flat, substantially rigid, bendable material which have their ends formed with collars 18, 19, 20, 21 respectively. The collars 18, 19 of the support 12 are coiled around the base of each side member 16 of the pair of frames 10, 11 and the collars 20, 21 of the support 13 are coiled around the base of each side member 17 of the pair of frames 10, 11 as shown. The collars are prevented from sliding up the side members 16, 17 by projections 22, 23, 24, 25. The collars are of sufficient depth to hold the frames substantially firmly standing in the upright position on the base members 15. This type of connection permits the frames to move between an inline position as shown in FIGS. 3 and 5, the maximum expanded position, and the closed position (FIG. 4). It will be apparent that other flexible means of connecting the frames into a unit may be employed. The means described is a convenient construction which permits the organizer to be adjusted to lay flat (FIG. 1) and fit into briefcases of various depths. When the organizer and its files are stood upright (FIG. 2) on base members 15, it is manually opened to the maximum expanded position. This feature adds to the stability of the organizer.

A compartment for writing accessories such as pens, pencils, etc. is provided and consists of a pocket 26 which is supported by the side members 16, 17. The pocket is preferably made of elastic material which stretches when mounted on the side members and will apply sufficient pressure to frictionally hold the pens, pencils etc. whenever they are inserted between the front and back folds 27, 28. As the pocket is of an elastic material it will also accommodate writing tools of various thickness. The pocket is preferably bottomless to accommodate writing tools of different lengths. After installation, the pouch can be divided into a plurality of separate vertical sections by means of dome or snap fasteners.

What I claim is:

1. A portable collapsible file holder and organizer comprising a pair of substantially rigid spaced frames forming a storage space therebetween, each of said frames having lateral side portions, top and bottom portions, said bottom portions forming a base on which the organizer stands when upright, and a pair of connecting members on which files are to be supported, said members adjustably interconnecting the frames adjacent the base only for to-and-fro adjustable movement of the frames relative to each other and to maintain said frames in spaced apart substantially parallel relationship between a fully opened position and a fully collapsed position and at intermediate positions therebetween whereby the frames retain said files in all said positions, the space between said frames being open and unobstructed above said base for receiving files therein, said files being supported either horizontally when said frames are horizontal or vertical when arranged upright.

2. A portable collapsible file holder according to claim 1 in which said connecting members comprise a pair of spaced apart links, one of said pair of links having the opposite ends thereof hingedly connected to the respective frames adjacent the base portion and the other of said pair being hingedly connected to the respective frame adjacent the base portion.

3. A portable collapsible file holder according to claim 2 in which each link comprises a strap-like portion having at each end a collar, the collars of one strap encircling oppositely disposed side portions of the pair of frames adjacent the base portion and the collars of the other strap encircling the other oppositely disposed side portions adjacent the base portion.

4. A portable collapsible file holder and organizer according to claim 1 including a pocket supported by at least one of said frames.

5. A portable collapsible file holder and organizer according to claim 4 including a pocket supported by at least one of said frames in which said pocket is divided into a plurality of separate compartments.

* * * * *